US008638540B2

(12) United States Patent
Burrows et al.

(10) Patent No.: US 8,638,540 B2
(45) Date of Patent: Jan. 28, 2014

(54) CORONA IGNITER INCLUDING IGNITION COIL WITH IMPROVED ISOLATION

(75) Inventors: John Antony Burrows, Northwich (GB); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 223 days.

(21) Appl. No.: 13/326,897

(22) Filed: Dec. 15, 2011

(65) Prior Publication Data

US 2012/0176724 A1 Jul. 12, 2012

Related U.S. Application Data

(60) Provisional application No. 61/423,306, filed on Dec. 15, 2010.

(51) Int. Cl.
*F23Q 3/00* (2006.01)

(52) U.S. Cl.
USPC ..... 361/247; 361/253

(58) Field of Classification Search
USPC ..... 361/247, 253, 256
See application file for complete search history.

(56) References Cited

U.S. PATENT DOCUMENTS 5,371,436 A 12/1994 Griswold et al.
5,705,892 A 1/1998 Codina et al.
6,374,816 B1 4/2002 Funk et al.
6,615,810 B2 9/2003 Funk et al.
6,873,094 B2 3/2005 Hiramatsu et al.
6,883,507 B2 4/2005 Freen
7,204,220 B2 4/2007 Schmidt et al.
7,741,761 B2 6/2010 Jaffrezic et al.
2004/0069288 A1 * 4/2004 Shimada et al. ..... 123/635
2010/0083942 A1 4/2010 Lykowski et al.
2010/0175653 A1 7/2010 Lykowski et al.
2010/0175655 A1 7/2010 Lykowski et al.
2010/0187999 A1 7/2010 Agneray et al.
2010/0282197 A1 11/2010 Permuy et al.
2011/0146640 A1 6/2011 Achstaetter et al.

FOREIGN PATENT DOCUMENTS

FR 2859831 A1 9/2012

* cited by examiner

*Primary Examiner* — Danny Nguyen
(74) *Attorney, Agent, or Firm* — Robert L. Stearns; Dickinson Wright, PLLC

(57) ABSTRACT

A corona igniter (20) includes an ignition coil (26) providing a high voltage energy to an electrode. The coil (26) is disposed in a housing (34) and electrically isolated by a coil filler (36) and a capacitance reducing component (38) which together improve energy efficiency of the system. The coil filler (36) includes an insulating resin permeating the coil (26). The capacitance reducing component (38) has a permittivity not greater than 6, for example ambient air, pressurized gas, insulating oil, or a low permittivity solid. The capacitance reducing compound (38) surrounds the coil (26) and other components and fills the remaining housing volume. The coil filler (36) has a filler volume and the capacitance reducing component (38) has a component volume greater than the filler volume.

19 Claims, 5 Drawing Sheets

FIG. 3
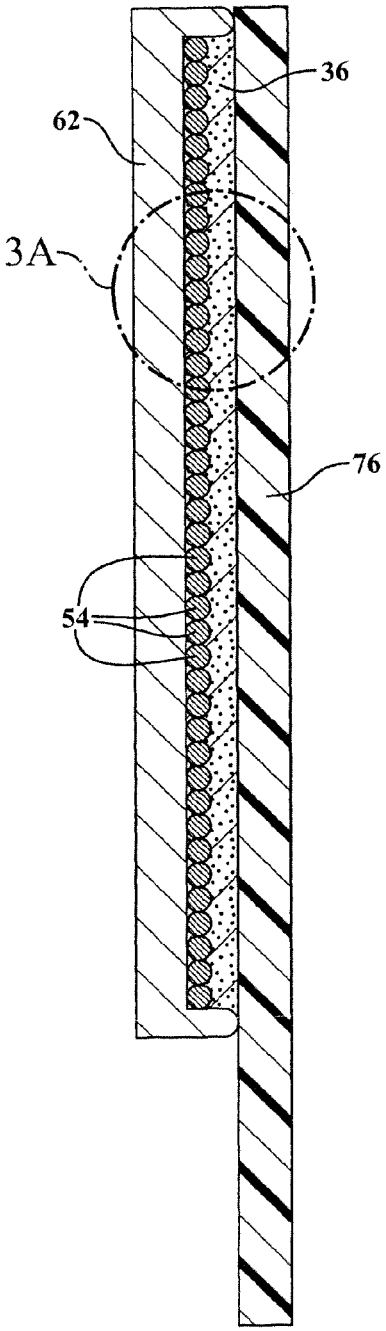
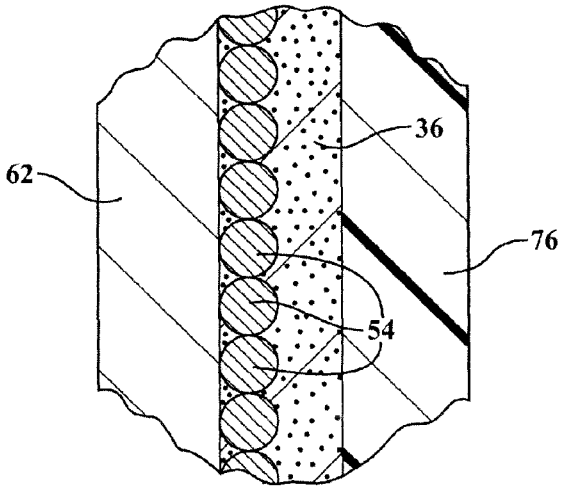
FIG. 3A
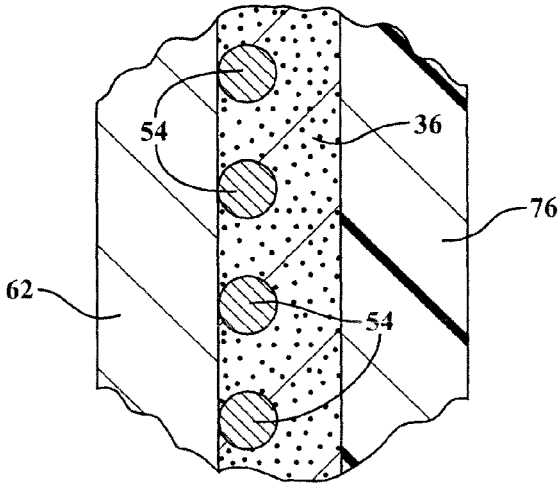
FIG. 3B

CORONA IGNITER INCLUDING IGNITION COIL WITH IMPROVED ISOLATION

CROSS REFERENCE TO RELATED APPLICATION

This application claims the benefit of U.S. provisional application Ser. No. 61/423,306, filed Dec. 15, 2010.

BACKGROUND OF THE INVENTION

1. Field of the Invention

This invention relates generally to a corona igniter for emitting a non-thermal plasma, and more specifically to isolation of an ignition coil of the corona igniter.

2. Related Art

An example of a corona discharge ignition system is disclosed in U.S. Pat. No. 6,883,507 to Freen. The corona discharge ignition system includes an igniter with an electrode charged to a high radio frequency voltage potential. An ignition coil housed in the igniter receives energy from a power source at a first voltage and transmits the energy to the electrode at a second voltage, typically 15 to 50 times higher than the first voltage. The electrode then creates a strong radio frequency electric field causing a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is also controlled so that the fuel-air mixture does not lose all dielectric properties, which would create a thermal plasma and an electric arc between the electrode and another portion of the igniter, or the grounded cylinder walls or piston.

The high frequency and high voltage used in the corona ignition system is difficult to contain, and leakage of energy through the housing of the ignition coil is a problem. Several techniques have been used to isolate the energy being transmitted through the ignition coil. Conventional isolation techniques, for example encapsulation with resin, such as epoxy resin, add significantly to the capacitance of the system and cause a parasitic energy loss. Thus, the output voltage and powder are reduced, while at the same time increasing the power required for operation.

The Freen patent discloses an electrical isolation method for corona igniters, which comprises filling the entire coil housing with an insulating pressurized gas. The pressurized gas maintains low parasitic energy loss but is difficult to execute with reliable stability and provides no mechanical support. Another isolation scheme used in corona ignition systems is filling the entire housing with a resin that penetrates the entire interior of the housing to provide mechanical support and thermal management. However, the completely resin filled housing leads to high parasitic energy loss and parasitic capacitance due to the high permittivity of the resin.

SUMMARY OF THE INVENTION

One aspect of the invention provides a corona igniter for providing a radio frequency electric field to ionize a portion of a fuel-air mixture and provide a corona discharge in a combustion chamber. The corona igniter comprises a housing including a plurality of walls presenting a total housing volume therebetween. A coil is disposed in the housing for receiving energy at a first voltage and transmitting the energy at a second voltage higher than the first voltage. An electrode is electrically coupled to the coil for receiving the energy and providing the radio frequency electric field. A coil filler formed of a resin material is disposed on the coil and a capacitance reducing component having a relative permittivity of less than 6 is disposed in the housing. The coil filler has a filler volume being a portion of the total housing volume, and the capacitance reducing component has a component volume being a portion of the total housing volume. The component volume is greater than the filler volume.

Another aspect of the invention provides a method of forming a corona igniter. The method comprises the step of providing a coil filler attached to a coil, wherein the coil filler includes a resin and has a filler volume and the coil has an inductance of at least 500 micro henries. The method next includes disposing the coil and the attached coil filler in a housing. The method also includes filling the housing with a capacitance reducing component having a relative permittivity of less than 6 and having a component volume being greater than the filler volume.

The coil filler and the capacitance reducing component electrically isolates the coil in the housing and thus creates less parasitic loss of energy from the coil during operation of the internal combustion engine compared to the corona igniters of the prior art with housings filled completely with a resin. The igniter requires less input power and outputs energy at a higher voltage and power due to less leakage of the energy through the housing. The improved insulation scheme provides improved energy efficiency with typically 30 to 50% less energy required compared to isolation schemes of the prior art corona igniters.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a cross-sectional view of a single-layer coil according to one embodiment of the invention;

FIG. 3A is an enlarged view of a section of FIG. 3;

FIG. 3B is a cross-sectional view of a single-layer coil according to another embodiment of the invention;

DETAILED DESCRIPTION

Figure 1:
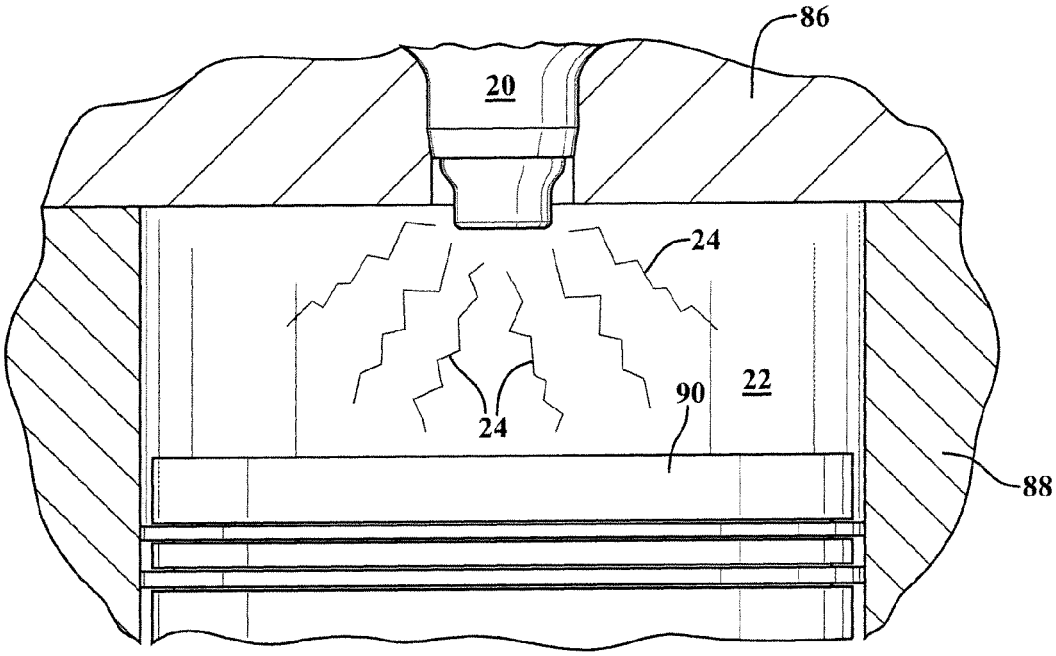
FIG. 1 is a cross-sectional view of a corona ignition system including an igniter according to one aspect of the invention.
Figure 2A:
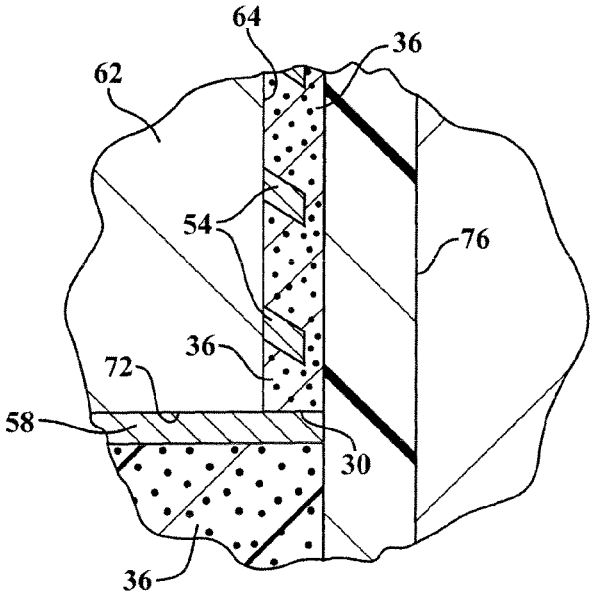
FIG. 2A is an enlarged view of a section of FIG. 2.
Figure 2:
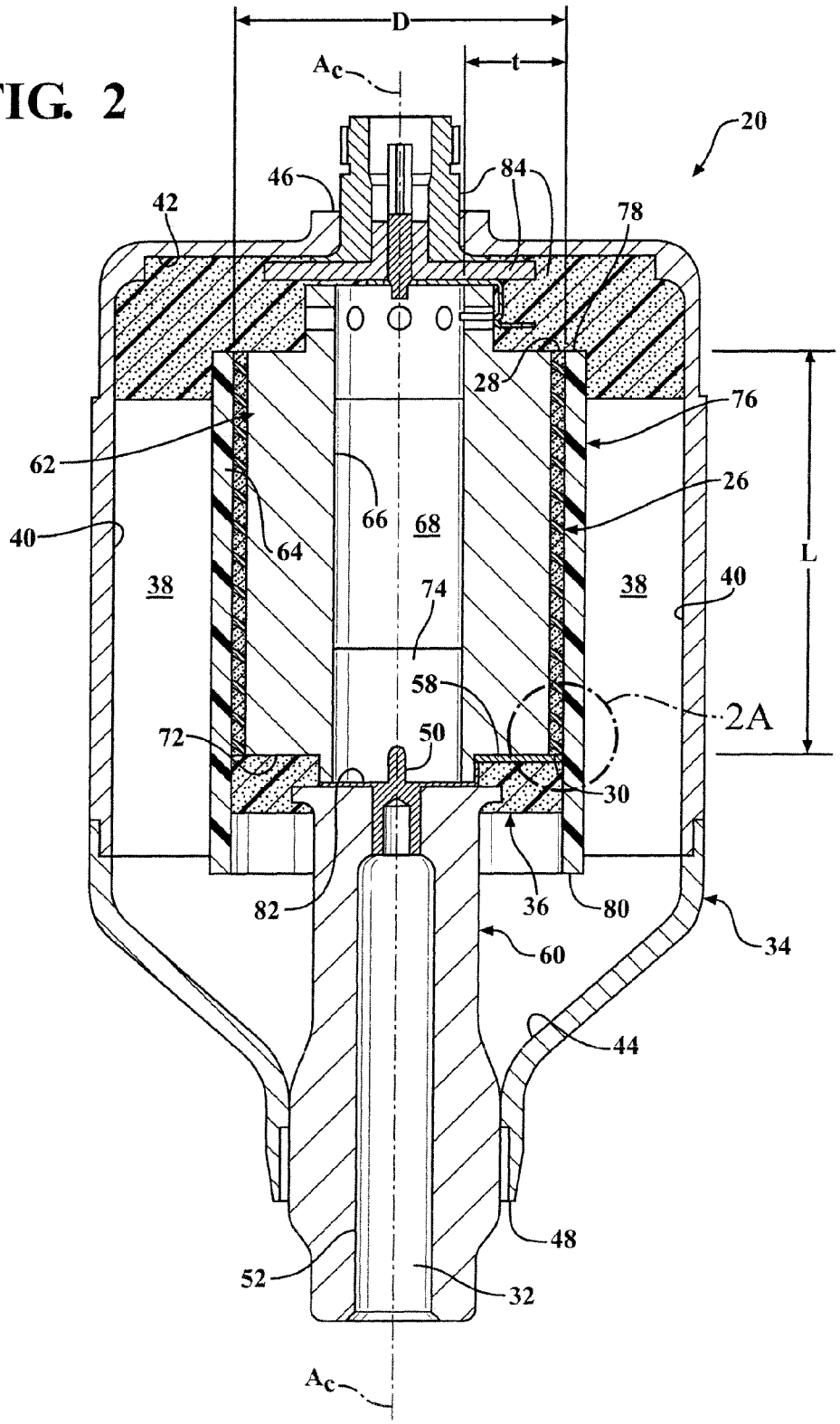
FIG. 2 shows a coil disposed in a housing of the igniter according to one embodiment of the invention.

One aspect of the invention provides a corona ignition system including an igniter 20, as shown in FIG. 1. The corona igniter 20 is disposed in a combustion chamber 22 and emits a radio frequency electric field to ionize a portion of a fuel-air mixture and provide a corona discharge 24 in the combustion chamber 22. The igniter 20 includes an ignition coil 26, as shown in FIG. 2, receiving energy at a coil low voltage end 28 from a power source (not shown) and transmitting the energy at a higher voltage from a coil high voltage end 30 to an electrode (not shown). Improved isolation of the ignition coil 26 is provided in a housing 34 of the coil 26. A minimal amount of a coil filler 36, such as a resin material, is coupled to the coil 26 and a capacitance reducing component 38, such as a pressurized gas, ambient air, insulating oil, or low permittivity solid fills the housing 34 around the coil 26. The coil filler 36 together with the capacitance reducing component 38 provide excellent mechanical support, thermal isolation, and electrical isolation with reduced parasitic capacitance compared to isolation schemes of the prior art corona igniters.

The housing 34 of the coil 26 includes a plurality of walls 40, 42, 44 surrounding the coil 26. The housing 34 includes spaced and parallel interior side walls 40 also extending parallel to the coil 26. An interior inlet wall 42 is disposed between the interior side walls 40 adjacent the coil low voltage end 28 and an interior outlet wall 44 is disposed between the interior side walls 40 adjacent the coil high voltage end 30. The interior walls 40, 42, 44 present a total housing volume therebetween. The total housing volume is the volume of the empty space between the walls 40, 42, 44 of the housing 34 before any components are disposed in the housing 34. In one embodiment, the total housing volume is between 11 $cm^3$ and 330 $cm^3$.

The walls 40, 42, 44 of the housing 34 are spaced from the coil 26 and the other components to provide a gap region therebetween. The gap region preferably extends continuously and circumferentially around the coil 26 and along the interior side walls 40 of the housing 34 and is filled with the capacitance reducing component 38. The housing 34 includes a low voltage inlet 46 extending through interior inlet wall 42 for allowing energy to travel from the energy supply to the coil 26. The housing 34 also includes a high voltage outlet 48 extending through interior outlet wall 44 opposite the low voltage inlet 46.

The coil 26 of the igniter 20 is disposed in the housing 34 between the low voltage inlet 46 and the high voltage outlet 48. The coil 26 receives the energy at the first voltage and transforms the energy to the second voltage higher than the first voltage before transmitting the energy at the second voltage to the electrode. The second voltage is typically at least 15 times higher than the first voltage. As shown in FIG. 2, the coil 26 extends longitudinally along a coil center axis $a_c$ from the coil low voltage end 28 receiving the energy to the coil high voltage end 30 transmitting the energy. The coil 26 has a length l extending from the coil low voltage end 28 to the coil high voltage end 30. In one embodiment, the length l of the coil 26 is between 20 mm and 75 mm.

The coil 26 includes a base formed of a conductive metal material, such as copper. In one embodiment, the coil 26 has an inductance of 500 micro henries to 2 milli henries. The coil 26 includes a plurality of windings 54 extending circumferentially around the coil center axis $a_c$, as shown in FIGS. 2 and 2A. The windings 54 are horizontally aligned with one another. The windings 54 present a perimeter around the coil center axis $a_c$ such that the coil 26 is spaced from the center axis $a_c$. The perimeter of the windings 54 presents a winding diameter d extending across the coil center axis $a_c$, as shown in FIG. 2. The windings 54 extend longitudinally along the coil center axis $a_c$, and a winding gap is disposed around each winding 54. The windings 54 may touch one another, or be grouped, separated, or spaced from one another for best performance.

Figure 4:
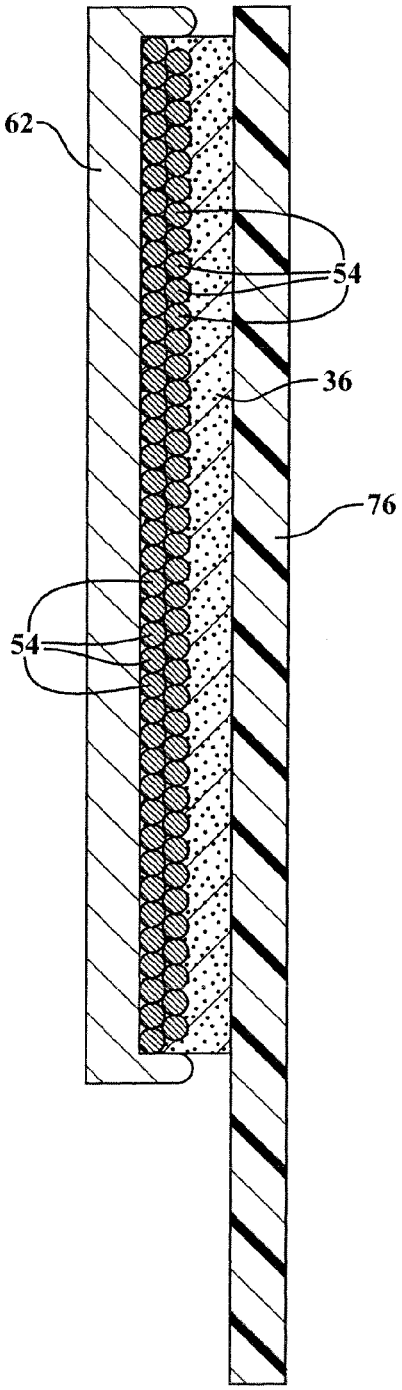
FIG. 4 is a cross-sectional view of a multi-layer coil according to another embodiment of the invention.
Figure 5:
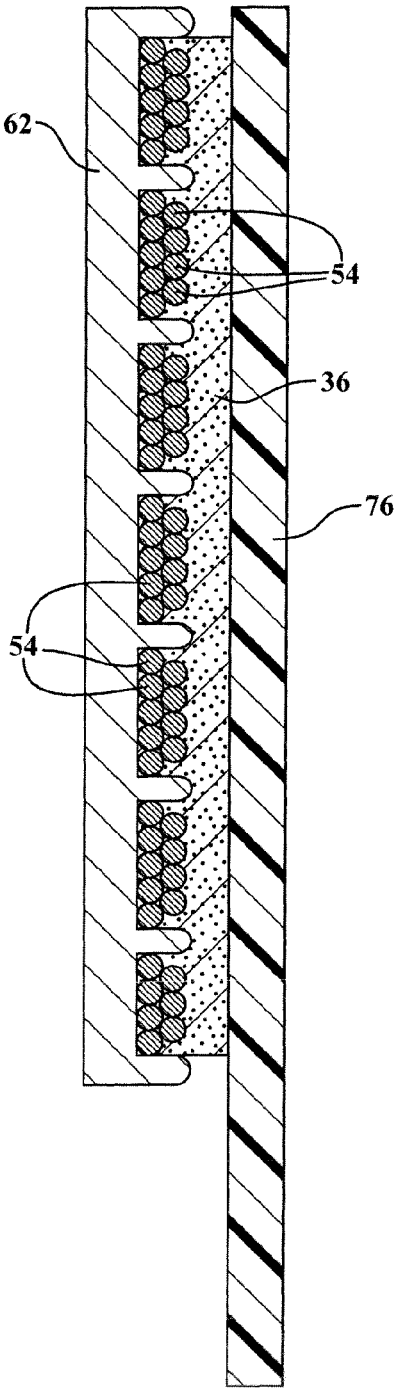
FIG. 5 is a cross-sectional view of a "binned" multi-layer coil according to yet another embodiment of the invention.

The coil 26 can include a single layer of windings 54, as shown in FIGS. 2 and 3. In the embodiment of FIG. 2, the coil 26 is a continuous winding 54. The windings 54 may abut one another, as shown in FIGS. 3 and 3A, with the winding gap around each of the windings 54. In another embodiment, the windings 54 are spaced from one another and the winding gap is located longitudinally between each winding 54, as shown in FIGS. 2 and 3B. In another embodiment, the coil 26 includes multiple layers of windings 54, as shown in FIGS. 4 and 5. In the embodiment of FIG. 5, the coil 26 includes a "binned" winding 43, where the coil former 62 contains multiple interconnected "bins", each containing a number of winding turns.

The coil 26 can be electrically coupled to the electrode according to a variety of methods. The igniter 20 can include a high voltage connector 60 received in the high voltage outlet 48 of the housing 34 and partially disposed in the housing 34 for assisting in the connection between the coil 26 and the electrode. In one embodiment, the high voltage connector 60 is a rubber boot. The high voltage connector 60 includes a recess 32 for receiving either an end of an igniter electrode firing end directly (not shown) or an extension (not shown) which carries the high voltage to the electrode firing end. A terminating connection 58 is typically disposed between the coil high voltage end 30 and the high voltage connection 60 for electrically coupling the coil 26 to the electrode and transmitting the energy from the coil 26 to the electrode.

The windings 54 of the coil 26 are typically maintained at the winding diameter d by a coil former 62 disposed between the coil center axis $a_c$ and the coil 26. The coil former 62 spaces the coil 26 from the coil center axis $a_c$. The coil former 62 includes an outside surface 64 having the winding diameter d and engaging the coil 26. The coil former 62 also includes an inside surface 66 extending circumferentially around the coil center axis $a_c$ and presenting a center cavity 68 along the coil center axis $a_c$. In one embodiment, the inside surface 66 of the coil former 62 is profiled. The coil former 62 extends longitudinally along the coil center axis $a_c$ from a former low voltage end 70 adjacent the coil low voltage end 28 to a former high voltage end 72 adjacent the coil high voltage end 30. The thickness of the coil former 62 can vary depending on ease of manufacture and the relative values of relative permittivity of the materials used.

In addition to maintaining the windings 54 in position, the coil former 62 provides electrical insulation to the coil 26 because the coil former 62 is formed of a non-magnetic, electrically insulating material. The coil former 62 preferably has a dielectric strength of at least 10 kV/mm, a relative permittivity of less than 8, and a thermal conductivity of at least 0.25 W/m.K. In one embodiment, the material of the coil former 62 includes at least one of nylon, Teflon, and PTFE. The coil former 62 also has a thickness t extending between the inside surface 66 and the outside surface 64 capable of providing electrical insulation. In one embodiment, the thickness t of the coil former 62 is from 1 mm to 14 mm.

The igniter 20 may also include a magnetic core 74 disposed in the center cavity 68 of the coil former 62 contributing to the inductance of the system. The magnetic core 74 is formed of an magnetic material, such as ferrite or powdered iron. In one embodiment, the magnetic core 74 has a relative permeability of at least 400. Alternately, the center cavity 68 may be filled with non-magnetic materials.

The igniter 20 also includes a tubular sleeve 76 having properties similar to the coil former 62. The tubular sleeve 76 is disposed in the housing 34 between the coil 26 and the interior side walls 40 of the housing 34 to position the coil 26. The tubular sleeve 76 extends circumferentially around the coil 26 and maintains the windings 54 of the coil 26 at the first diameter. The tubular sleeve 76 also spaces the windings 54 from the interior side walls 40 of the housing 34. The tubular sleeve 76 extends longitudinally from a tubular low voltage end 78 adjacent the coil low voltage end 28 to a tubular high voltage end 80. The tubular high voltage end 80 extends past the coil high voltage end 30 and is disposed between the coil high voltage end 30 and the high voltage outlet 48 of the housing 34. The thickness of the tubular sleeve 76 can vary depending on ease of manufacture and the relative values of relative permittivity of the materials used.

The coil filler 36 formed of the resin material is disposed on and coupled to the coil 26 adjacent the capacitance reducing component 38 to provide thermal stability and electrical isolation and prevent overheating and electrical loss due to the high voltage energy traveling through the coil 26. The coil filler 36 also provides mechanical support and maintains the coil 26 in position relative to the housing 34. As shown in FIGS. 2 and 2A, the coil filler 36 is preferably disposed in the tubular sleeve 76 at the coil high voltage end 30 and permeates the windings 54. Thus, the coil filler 36 is disposed in at least one of the winding gaps around the windings 54, and preferably in a plurality or all of the winding gaps around the windings. FIGS. 2A-5 show the coil filler 36 disposed in the winding gaps, between the windings 54 and the tubular sleeve 76.

As shown in FIG. 2, the coil filler 36 extends along the tubular sleeve 76 toward the tubular high voltage end 80. The coil filler 36 also extends from the tubular sleeve 76 along the former high voltage end 72 to the high voltage connector 60. The coil filler 36 is coupled to the coil 26 and the connector end 82 of the high voltage connector 60 to maintain the coil 26 in position relative to one another. In one embodiment, a portion of the terminating connection 58 is sandwiched between the coil filler 36 and the coil former 62, as shown in FIGS. 2 and 2A. In an alternate embodiment, the coil filler 36 extends into the center cavity 68 to secure the optional magnetic core 74 in position relative to the coil 26.

The coil filler 36 is spaced from the walls 40, 42, 44 of the housing 34 and disposed adjacent the capacitance reducing component 38. The coil filler 36 has a filler volume occupying a portion of the total housing volume. In one embodiment, the filler volume is at least 10% of the total housing volume, or less than 70% of the total housing volume, or 10 to 7% of the total housing volume, and preferably less than 40% of the total housing volume. The filler volume is the volume of the coil filler 36 after curing the resin and can be measured before or after disposing the coil filler 36 in the housing 34.

In one embodiment, the coil filler 36 has a dielectric strength of at least 10 kV/mm, a thermal conductivity of at least 0.5 W/m.K, and a relative permittivity of less than 6. Examples of the coil filler 36 include silicone resin and epoxy resin. The resin is disposed on the coil 26 and then cured to provide the coil filler 36. In one embodiment, the tubular sleeve 76 is removed after curing the resin to reduce the diameter of the components in the housing 34. The coil filler 36 remains coupled to the coil 26 and the other components adjacent the capacitance reducing component 38.

The igniter 20 includes the capacitance reducing component 38 surrounding the coil 26 and filling the housing 34. As shown in FIG. 2, the capacitance reducing component 38 is disposed in the gap region between the electrical components and the interior walls 40, 42, 44 of the housing 34. If the central cavity 68 does not contain a magnetic core 74, the capacitance reducing component 38 may beneficially fill this region. The capacitance reducing component 38 minimizes unwanted capacitance in the housing 34. The capacitance reducing component 38 and the coil filler 36 together provide improved isolation and less parasitic energy loss compared to isolation schemes used in corona igniters of the prior art.

The capacitance reducing component 38 has a component volume consuming a portion of the total housing volume. The component volume is separate from the filler volume and is greater than the filler volume. In one embodiment, the component volume is at least 2 times greater than the filler volume. The component volume is the volume of the capacitance reducing component 38, which can be measured before or after the capacitance reducing component 38 is disposed in the housing 34. In one embodiment, the component volume is at least 20% of the total housing volume, and preferably more than 50% of the total housing volume, or 20 to 90% of the total housing volume.

In one embodiment, the housing 34 is filled with the capacitance reducing component 38 after all the other components are disposed in the housing 34. The capacitance reducing component 38 typically extends continuously around the coil 26 and along the length l of the coil 26. In one embodiment, the capacitance reducing component 38 extends along at least 50% of the length l and preferably 100 to 150% of the length l of the coil 26. The capacitance reducing component 38 also typically extends continuously around the circumference of the windings 54 and continuously from the windings 54 to the interior side walls 40 of the housing 34. As shown in FIG. 2, the capacitance reducing component 38 is disposed along the interior side walls 40 and can be disposed along the other walls 42, 44 of the housing 34.

The capacitance reducing component 38 has a low relative permittivity to minimize unwanted capacitance in the housing 34. The relative permittivity of the capacitance reducing component 38 is less than the relative permittivity of the coil filler 36. In one embodiment, the capacitance reducing component 38 has a relative permittivity of not more than 6 and preferably 1 to 4. The capacitance reducing component 38 also has a thermal conductivity of more than 0.125 W/m.K. In one embodiment, capacitance reducing component 38 has a dielectric strength of at least 3 kV/mm and preferably more than 10 kV/mm.

In one embodiment, the housing volume that remains after all the components, besides the capacitance reducing component 38, are disposed in the housing 34 remains unfilled. In this embodiment, the capacitance reducing component 38 is simply ambient air. The capacitance reducing component 38 filling the housing 34 can alternatively comprise another low permittivity material, such as a gas at atmospheric pressure or an elevated pressure. In one embodiment, the capacitance reducing component 38 is a gas having a pressure not greater than 10 bar. The gas can have a dielectric strength of at least 3 kV/mm and a relative permittivity of less than 2.

In another embodiment, the capacitance reducing component 38 is a liquid, such as an insulating oil, for example ester oil. The oil can have a dielectric strength of at least 10 kV/mm, a thermal conductivity of more than 0.125 W/m.K, and a relative permittivity of less than 4. In yet another embodiment, the capacitance reducing component 38 is a low permittivity solid, for example Boron Nitride or PTFE or polyethylene. The solid can have a dielectric strength of at least 10 kV/mm, a thermal conductivity of more than 0.125 W/m.K, and a relative permittivity of less than 4. In an alternate embodiment, the capacitance reducing component 38 includes a combination of gases, or a combination of elements, for example the ambient air and the low permittivity solid.

As shown in FIG. 2, the igniter 20 can also include a retainer 84 attaching the coil 26 to the housing 34. The retainer 84 engages the coil former 62 and may engage other components coupled to the coil 26. The retainer 84 can be any conventional retainer 84, such as a screw, clamp, interference fit, glue, or potting material. The retainer 84 can also be provided by welding or crimping. In one embodiment, several retainers 84 are used to secure the coil 26 to the housing 34, as shown in FIG. 2.

One of the retainers 84 of FIG. 2 is a potting material disposed along the interior inlet wall 42 and a portion of the interior side walls 40 of the housing 34. The potting material extends from the walls 40, 42 to the tubular sleeve 76, to the coil 26, to the coil former 62, and to the center cavity 68. The potting material surrounds the coil low voltage end 28, the former low voltage end 70, and the tubular low voltage end 78. The potting material has a volume less than the volume of the capacitance reducing component 38. The potting material is also spaced a significant distance from the coil high voltage end 30. Thus, the potting material provides beneficial electrical isolation.

The potting material may be the same material as coil filler 36. Alternately, the potting material may have a composition different from the coil filler 36. The potting material may be a solid or a gel, such as a thermoset plastic or a silica gel. In one embodiment, the potting material has a dielectric strength of at least 10 kV/mm, a thermal conductivity of at least 0.15 W/m.K, and a relative permittivity of less than 6.

The igniter 20 is typically disposed in a cylinder head 86 of an internal combustion engine of an automotive vehicle, as shown in FIG. 1. The cylinder head 86 is disposed on a cylinder block 88, and a piston 90 is disposed in the cylinder block 88, such that the cylinder head 86, cylinder block 88, and piston 90 together provide a combustion chamber 22 therebetween. The corona igniter 20 receives the energy from the power supply (not shown), transforms the energy to the higher voltage, and emits the radio frequency electric field to ionize the fuel-air mixture and provide the corona discharge 24 in the combustion chamber 22. The power supply is typically a 12 volt battery of the vehicle.

The igniter 20 including the coil filler 36 and the capacitance reducing component 38 in the housing 34 electrically isolates the coil 26 and thus creates less parasitic loss of energy from the coil 26 during operation of the internal combustion engine than corona igniters of the prior art with housings filled completely with a resin or other electrically isolating filler material. The igniter 20 requires less input power and outputs energy at a higher voltage and power due to less leakage of the energy through the housing 34. The improved insulation scheme of the present invention provides improved energy efficiency and typically 30 to 50% less energy required compared to isolation schemes of prior art corona igniters.

Figure 6:
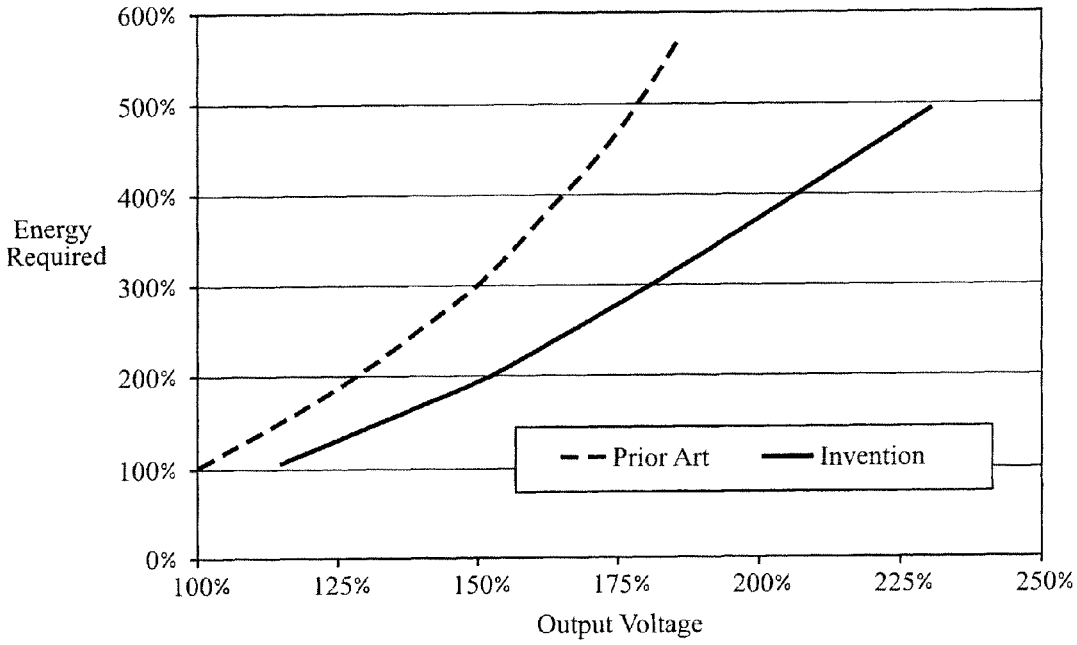
FIG. 6 is a graph illustrating energy input required compared to igniter output voltage for a corona igniter of the prior art and a corona igniter according one embodiment of the invention.

FIG. 6 shows the energy input required (vertical axis) compared to the igniter output voltage (horizontal axis) for a corona igniter of the prior art and a corona igniter 20 according to one embodiment of the invention operating under identical conditions. The graph illustrates that inventive corona igniter 20 requires between 30 and 50% less energy than the corona igniter of the prior art.

Figure 7:
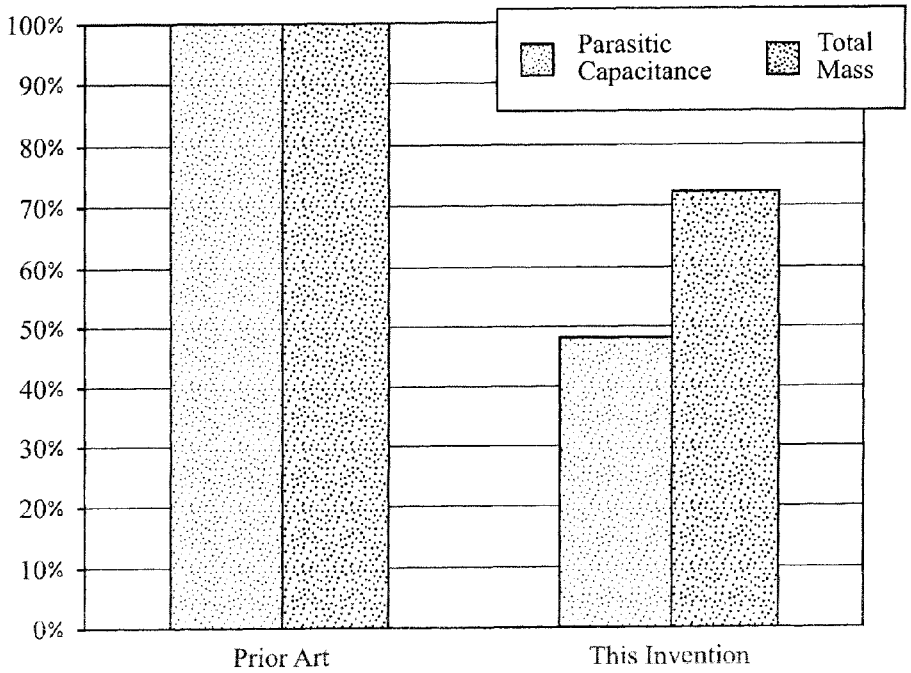
FIG. 7 is a graph illustrating parasitic capacitance and mass of a corona igniter of the prior art and a corona igniter according one embodiment of the invention.

FIG. 7 shows the parasitic capacitance of a prior art corona igniter and a corona igniter 20 according to one embodiment of the invention. Also shown is the relative mass of each design. The inventive corona igniter 20 provides a 50% drop in parasitic capacitance which leads to a reduction in required energy and input current. The inventive corona igniter 20 also provides a 30% drop in total mass which leads to reduced cost, better vibration performance, easier packaging onto the engine and a contribution to improved fuel efficiency.

Another aspect of the invention provides a method of forming the corona igniter 20. The method includes providing the coil filler 36 attached to the coil 26. The attaching step preferably includes disposing the uncured resin along the coil high voltage end 30 of the coil 26 and curing the resin to provide the coil filler 36 having the filler volume. The method next includes disposing the coil 26 and the attached coil filler 36 in the housing 34. The other components are also disposed in the housing 34 and the coil is eclectically coupled to the electrode.

The method further includes filling the housing 34 with the capacitance reducing component 38 having the relative permittivity of less than 6 and having the component volume being greater than the filler volume. The housing 34 is typically filled with the capacitance reducing component 38 after the other components are disposed in the housing 34. In one embodiment, the capacitance reducing component 38 is ambient air, so the step of filing the housing 34 includes allowing the ambient air to enter the housing 34, which typically occurs naturally during the assembly process. In another embodiment, the pressured gas is pumped into the housing 34. The method includes filling at least 20% of the total housing volume and preferably more than 50% of the total housing volume with the capacitance reducing component 38.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

ELEMENT LIST

| Element Symbol | Element Name |
|---|---|
| D | winding diameter |
| L | length |
| T | thickness |
| 20 | igniter |
| 22 | chamber |
| 24 | discharge |
| 26 | coil |
| 28 | coil low voltage end |
| 30 | coil high voltage end |
| 32 | recess |
| 34 | housing |
| 36 | coil filler |
| 38 | capacitance reducing component |
| 40 | interior side walls |
| 42 | interior inlet wall |
| 44 | interior outlet wall |
| 46 | inlet |
| 48 | outlet |
| 50 | electrode terminal end |
| 52 | electrode body portion |
| 54 | windings |
| 58 | terminating connection |
| 60 | high voltage connector |
| 62 | coil former |
| 64 | outside surface |
| 66 | inside surface |
| 68 | center cavity |
| 70 | former low voltage end |
| 72 | former high voltage end |
| 74 | magnetic core |

-continued

| ELEMENT LIST | |
|---|---|
| Element Symbol | Element Name |
| 76 | tubular sleeve |
| 78 | tubular low voltage end |
| 80 | tubular high voltage end |
| 82 | connector end |
| 84 | retainer |
| 86 | cylinder head |
| 88 | cylinder block |
| 90 | piston |
| $a_c$ | coil center axis |

What is claimed is:

1. A corona igniter (20) for providing a radio frequency electric field to ionize a portion of a fuel-air mixture and provide a corona discharge (24) in a combustion chamber (22), comprising:

a housing (34) including a plurality of walls (40, 42, 44) presenting a total housing volume therebetween, a coil (26) disposed in said housing (34) for receiving energy at a first voltage and transmitting the energy at a second voltage higher than the first voltage, an electrode electrically coupled to said coil (26) for receiving the energy and providing the radio frequency electric field, a coil filler (36) formed of a resin material disposed on said coil (26), said coil filler (36) having a filler volume being a portion of said total housing volume, a capacitance reducing component (38) having a relative permittivity of less than 6 disposed in said housing (34), said capacitance reducing component (38) having a component volume being a portion of said total housing volume and being greater than said filler volume.

2. The corona igniter (20) of claim 1 wherein said capacitance reducing component (38) is at least 20% of said total housing volume and said filler volume is at least 10% of said total housing volume.

3. The corona igniter (20) of claim 1 wherein said filler volume is 10 to 70% of said total housing volume.

4. The corona igniter (20) of claim 1 wherein said component volume is 20 to 90% of said total housing volume.

5. The corona igniter (20) of claim 1 wherein said component volume is at least two times greater than said filler volume.

6. The corona igniter (20) of claim 1 wherein said capacitance reducing component (38) extends continuously around said coil (26).

7. The corona igniter (20) of claim 1 wherein said coil (26) includes a plurality of windings (54) and a winding gap around said windings (54) and wherein said coil filler (36) is disposed in said winding gaps.

8. The corona igniter (20) of claim 7 wherein said windings (54) extend circumferentially around a coil center axis ($a_c$) and said capacitance reducing component (38) extends continuously around said windings (54) along said housing (34).

9. The corona igniter (20) of claim 1 wherein said coil (26) has a length (l) extending from a coil low voltage end (28) receiving the energy to a coil high voltage end (30) transmitting the energy and said capacitance reducing component (38) extends along at least 50% of said length (l).

10. The corona igniter (20) of claim 9 wherein said coil filler (36) is disposed at said coil high voltage end (30).

11. The corona igniter (20) of claim 9 including a retainer (84) formed of an electrically insulating material separate from said coil filler (36) coupling said coil low voltage end (30) to said housing (34).

12. The corona igniter (20) of claim 1 wherein said capacitance reducing component (38) has a dielectric strength of at least 3 kV/mm.

13. The corona igniter (20) of claim 1 wherein said capacitance reducing component (38) includes at least one of a gas, an oil having a dielectric strength of at least 3 kV/mm, a liquid having a dielectric strength of at least 10 kV/mm, and a solid having a permittivity less than 6.

14. The corona igniter (20) of claim 13 wherein said gas includes at least one of ambient air and a gas having a pressure of not greater than 10 bar.

15. The corona igniter (20) of claim 1 wherein said coil filler (36) has a dielectric strength of at least 10 kV/mm and a relative permittivity of less than 8.

16. A corona igniter (20) for providing a radio frequency electric field to ionize a portion of a fuel-air mixture and provide a corona discharge (24) in a combustion chamber (22), comprising:

a housing (34) having interior walls (40, 42, 44) presenting a total housing volume therebetween, a coil (26) disposed in said housing (34) for receiving energy at a first voltage and transmitting the energy at a second voltage being at least 15 times higher than the first voltage, said coil (26) extending longitudinally along a coil center axis ($a_c$) and having a length (l) extending from a coil low voltage end (28) receiving the energy at the first voltage to a coil high voltage end (30) transmitting the energy at the second voltage, said coil (26) having an inductance of at least 500 micro henries, said coil (26) including a plurality of windings (54) horizontally aligned with one another and extending longitudinally along said coil center axis ($a_c$) and a winding gap disposed around each of said windings (54), said windings (54) presenting a perimeter around said coil center axis ($a_c$) and having a winding diameter (d) extending across said coil center axis ($a_c$), a coil former (62) formed of electrically insulating resin material disposed along said coil center axis ($a_c$) and spacing said windings (54) from said coil center axis ($a_c$), a coil filler (36) formed of electrically insulating resin material different from said coil former (62) disposed in said housing (34) at said coil high voltage end (30) and disposed in said winding gap around windings (54), said coil filler (36) having a dielectric strength of at least 3 kV/mm, a thermal conductivity of at least 0.125 W/m.K, and a relative permittivity of at less than 6, said coil filler (36) having a filler volume of 10 to 70% of said total housing volume, an electrode electrically coupled to said coil (26) for receiving the energy from said coil (26), a gap region disposed between said coil (26) and said interior walls (40, 42, 44) of said housing (34), a capacitance reducing component (38) having a relative permittivity of less than 6 and a component volume filing said gap region of said housing (34), said capacitance reducing component (38) extending continuously around said coil (26) and along said interior walls (40, 42, 44) of said housing (34), said capacitance reducing component (38) disposed along at least 50% of said length (l) of said coil (26), said component volume being greater than said filler volume, said component volume being 20 to 90% of said total housing volume, said capacitance reducing component (38) having a dielectric strength of at least 3 kV/mm, and said capacitance reducing component (38) including at least one of a gas, an oil having a dielectric strength of at least 3 kV/mm, a liquid having a dielectric strength of at least 10 kV/mm, and a solid having a permittivity of less than 6.

17. A method of forming a corona igniter (20) for providing a radio frequency electric field to ionize a portion of a fuel-air mixture and provide a corona discharge (24) in a combustion chamber (22), comprising the steps of:

providing a coil filler (36) attached to a coil (26), wherein the coil filler (36) includes a resin and has a filler volume and the coil (26) has an inductance of at least 500 micro henries, disposing the coil (26) and the attached coil filler (36) in a housing (34), and filling the housing (34) with a capacitance reducing component (38) having a permittivity of less than 6 and having a component volume being greater than the filler volume.

18. The method of claim 17 wherein the step of filling the housing (34) with the capacitance reducing component (38) includes filling at least 20% of a total housing volume.

19. The method of claim 17 wherein the step of providing the coil filler (36) attached to the coil (26) includes disposing the resin on the coil (26) and curing the resin.

* * * * *